US005779540A

United States Patent [19]

Nailor

[11] Patent Number: 5,779,540

[45] Date of Patent: Jul. 14, 1998

[54] FLUID FLOW CONTROL DAMPER

[75] Inventor: Lance P. Nailor, The Woodlands, Tex.

[73] Assignee: Nailor Industries of Texas, Inc., Houston, Tex.

[21] Appl. No.: 797,597

[22] Filed: Feb. 7, 1997

[51] Int. Cl.[6] ..... A62C 2/12

[52] U.S. Cl. ..... 454/369; 137/79

[58] Field of Search ..... 454/369, 342; 137/79

[56] References Cited

U.S. PATENT DOCUMENTS

| | | | |
|---|---|---|---|
| 4,039,123 | 8/1977 | Frankel . | |
| 4,080,978 | 3/1978 | McCabe | 137/79 |
| 4,432,272 | 2/1984 | Becelaere | 98/1 |
| 4,911,065 | 3/1990 | Van Becelaere | 98/1 |
| 5,533,929 | 7/1996 | Attridge, Jr. | 454/369 |

FOREIGN PATENT DOCUMENTS

| | | |
|---|---|---|
| 964682 | 3/1975 | Canada . |
| 1194356 | 10/1985 | Canada . |

OTHER PUBLICATIONS

Drawing entitled "Position Indicator Switch Pack Installation Instruction Model Series MLS–300 Models: JS–300 and DD–300," Nailor Industries Inc., Oct. 1990.

Drawing entitled "Position Indicator Switch Pack for Combination Fire/Smoke, Smoke and Control Dampers–Model Series MLS–300," Nailor Industries Inc., Oct. 1990.

Drawing entitled "Reopenable Sensor with Position Indicator Switch Pack Installation Indstructions Model Series MLS–400, Model: JS–400," Nailor Industries Inc., Oct. 1990.

Catalog, Model 124 Leakage Rated Airfoil Blade Fire/Smoke Damper with Unique Sens–o–Therm Feature, Classified by Underwrites Laboratories UL555s, Air Balance Inc., 1986.

Brochure, FSD60 Low Leakage Combination Fire Smoke Damper UL555s, Ruskin Mfg. Co., 1984.

Automatic Damper Operator–Model FM–5590, Rixson Firemark Inc., 1972.

Drawing entitled Reopenable Sensor With Position Indicator Switch Pack–Model Series MLS–400–Model: JS–400, Oct. 1990.

Drawing entitled Reopenable Sensor With Position Indicator Switch Pack Installation Instructions–Model Series MLS–400, Model: JS–400, Oct. 1990.

Drawing entitled Reopenable Control System With Position Indicator Switch Pack–Model Series MLS–350, Model: JS–350, Oct. 1990.

Drawing entitled Reopenable Control System Wuth Position Indicator Switch Pack Installation Instructions–Model Series MLS–350, Model: JS–350, Oct. 1990.

Barber Colman Drawing, Nov. 13, 1963.

Barber Colman Drawing, Jul. 22, 1981.

Underwriters Laboratories Inc. Report entitled "Report of May 6 and 7, 1987 Meeting of UL's Industry Advisory Conference (IAC) For Fire Dampers," Northbrook, Illinois, Jun. 17, 1987.

*Primary Examiner*—Harold Joyce
*Assistant Examiner*—Derek S. Boles
*Attorney, Agent, or Firm*—Killworth, Gottman, Hagan & Schaeff, L.L.P.

[57] ABSTRACT

A damper is provided which is adapted to be positioned in a building conduit to control the flow of fluid through the conduit. The damper includes a frame and barrier structure coupled to the frame which is movable between open and closed positions. The barrier structure permits fluid to flow through the conduit when positioned in the open position and substantially blocks fluid flow through the conduit when positioned in the closed position. The damper further includes an actuator which is coupled to the barrier structure for effecting movement of the barrier structure. A control circuit is also provided and is connected to the actuator for controlling the operation of the actuator. The control circuit includes a thermal responsive switch which, preferably, is located outside of the conduit. The thermal responsive switch prevents operation of the actuator when the temperature of fluid surrounding the switch exceeds a first predetermined value.

25 Claims, 4 Drawing Sheets

FLUID FLOW CONTROL DAMPER

BACKGROUND OF THE INVENTION

The present invention relates to dampers for use in building conduits to control the flow of fluid through such conduits.

U.S. Pat. No. 4,432,272 discloses a motor operated fire damper which is adapted to be used in heating or ventilating conduits of buildings to protect against the transmission of fire or smoke through the conduits. The damper comprises a peripheral frame and a plurality of generally rectangular blades which are rotatably coupled to the frame and to a motor. A thermal responsive switch senses the temperature of the fluid inside the building conduit at a point near the damper. When the temperature in the conduit exceeds a predetermined level, the switch is actuated causing power to the motor to be interrupted. When power is interrupted, a spring associated with the motor causes the blades to close, thereby closing off the conduit at the point where the damper is located.

The motor, which is positioned outside of the conduit, may become damaged by heat or fire before the temperature in the conduit exceeds the predetermined amount. If the motor is damaged such that it becomes locked in the "blade open position," the spring may not be sufficient to effect closure of the blades. Hence, the blades may not be moved so as to close off the conduit to the transmission of fire or, smoke through the conduit.

It is also noted that the damper disclosed in the '272 patent does not have a secondary or "back-up" mechanism for effecting closure of the blades should the thermal responsive switch fail or the motor become locked in the blade open position.

Accordingly, there is a need for an improved fire damper which, among other things, is capable of closing before fire or heated fluid effects damage to the damper motor or actuator.

SUMMARY OF THE INVENTION

In accordance with the present invention, a damper is provided having a thermal responsive switch which, preferably, is positioned to sense the temperature of fluid outside of the heating or ventilating conduit in which the damper is employed. When the temperature of the fluid outside the conduit exceeds a first predetermined value, the switch is actuated causing power to a damper motor or actuator to be interrupted such that the damper closes, thereby closing off the heating or ventilating conduit to the transmission of fire or smoke through the conduit. Preferably, the damper further includes a mechanical closure mechanism for effecting closure of the damper when the temperature of fluid within the conduit exceeds a second predetermined value. The second value preferably exceeds the first value. An override switch is further provided. Thus, if the damper is closed in response to actuation of the thermal responsive switch and the mechanical closure mechanism has not been operated, the override switch may be used to bypass the thermal responsive switch so as to reopen the damper. Reopening of a damper in a particular section of a building conduit may be desirable so as to vent toxic fumes or smoke from the building. Reopening of the damper may also provide useful information to an operator charged with safety in a building. If the damper can be reopened, the operator knows that the damper was closed due to actuation of the thermal responsive switch. Hence, the heat source is most likely located outside of the conduit. If the damper cannot be reopened, the operator knows that the temperature within the conduit is equal to or exceeds the second predetermined value. Thus, heated fluid or fire is located within the conduit.

In accordance with a first aspect of the present invention, a damper is provided which is adapted to be positioned in a building conduit to control the flow of fluid through the conduit. The damper includes a frame and barrier structure coupled to the frame which is movable between open and closed positions. The barrier structure permits fluid to flow through the conduit when positioned in the open position and substantially blocks fluid flow through the conduit when positioned in the closed position. The damper further includes an actuator which is coupled to the barrier structure for effecting movement of the barrier structure. A control circuit is also provided and is connected to the actuator for controlling operation of the actuator. The control circuit includes a first thermal responsive switch which, preferably, is located outside of the conduit. The thermal responsive switch prevents operation of the actuator when the temperature of fluid surrounding the switch exceeds a first predetermined value.

Preferably, the control circuit further includes an override switch which bypasses the thermal responsive switch so that the actuator may be operated even though the thermal responsive switch is in its actuated state in response to the temperature of the fluid surrounding the switch exceeding the first predetermined value. The control circuit may also include first and second indicator lamps. The first indicator lamp is activated when the barrier structure is positioned in its open position and the second indicator lamp is activated when the barrier structure is positioned in its closed position.

The barrier structure preferably comprises a plurality of barrier blades pivotably mounted to the frame and coupled to the actuator via coupling structure. The blades are movable between an open position such that they permit fluid flow through the conduit and a closed position where they substantially block fluid flow through the conduit. The coupling structure may comprise a drive shaft coupled to the actuator and linkage structure fixedly coupled to the shaft and to the blades such that rotation of the shaft via the actuator effects movement of the blades between the open and closed positions.

The conduit may include a sleeve and at least one duct portion which is coupled to the sleeve. The thermal responsive switch may be fixedly connected to any portion of the conduit, the damper frame or the building in which the damper is located. In a first embodiment of the present invention, the frame is positioned within the sleeve and the thermal responsive switch is coupled to the sleeve. In another embodiment of the present invention, the thermal responsive switch is located in a room spaced from the conduit.

Preferably, the damper further includes a mechanical closure mechanism for effecting closure of the barrier structure when the temperature of fluid within the conduit exceeds a second predetermined value. The second value is preferably greater than the first value. However, the two values may be substantially equal to one another or the first value may exceed the second value.

The mechanical closure mechanism includes a first mechanical closure link fixedly coupled to the drive shaft and including a first pin, and a second linkage structure rotatably coupled to the drive shaft and fixedly coupled to at least one of the barrier blades such that movement of the second linkage structure effects movement of the blades.

The second linkage structure includes a second pin. The closure mechanism further includes a torsion spring adapted to engage the first and second pins, and a fusible link connected to the first and second pins for preventing the torsion spring from effecting movement of the second linkage structure when the temperature of the fluid within the conduit is less than the second value and failing when the temperature of the conduit fluid substantially equals or exceeds the second value thereby allowing the torsion spring to effect movement of the second linkage such that the barrier blades are substantially closed.

In a further embodiment of the present invention, a tube is provided which extends through the sleeve so as to provide a path for heated air to move from inside the sleeve to outside the sleeve.

In another embodiment of the present invention, the control circuit further includes a second thermal responsive switch positioned so as to sense the temperature of fluid at a location within the conduit. The second switch prevents operation of the actuator when the temperature of fluid surrounding the switch exceeds a third predetermined value. The third predetermined value may be equal to the first value or it may be less than or greater than the first value. The second switch may be used in place of the mechanical closure mechanism or may be used in combination with the mechanical closure mechanism.

In accordance with a second aspect of the present invention, a damper is provided which is adapted to be positioned in a building conduit to control the flow of fluid through the conduit. The damper comprises a frame and barrier structure coupled to the frame which is movable between open and closed positions. The barrier structure permits fluid to flow through the conduit when positioned in the open position and substantially blocks fluid flow through the conduit when positioned in the closed position. The damper further comprises an actuator coupled to the barrier structure for effecting movement of the barrier structure, and a control circuit connected to the actuator and a power source for coupling the power source to the actuator. The control circuit includes a thermal responsive switch positioned so as to sense the temperature of fluid at a location outside of the conduit. The switch decouples the power source from the actuator when the temperature of the fluid surrounding the switch is above a first predetermined value.

Preferably, the control circuit further includes an override switch which acts as a bypass to the thermal switch such that the power source remains coupled to the actuator even though the thermal responsive switch is in its actuated state in response to the temperature of the fluid surrounding the switch exceeding the first predetermined value.

The thermal responsive switch may be fixedly connected to any portion of the conduit, the damper frame or the building in which the damper is located.

Accordingly, it is an object of the present invention to provide an improved damper adapted to be positioned in a building conduit to control the flow of fluid through the conduit. Further, it is an object of the present invention to provide a damper having a thermal responsive switch positioned so as to sense the temperature of fluid at a location outside of the conduit. These and other objects of the present invention will be apparent from the following description, the accompanying drawings and the appended claims.

DETAILED DESCRIPTION OF THE INVENTION

Figure 1:
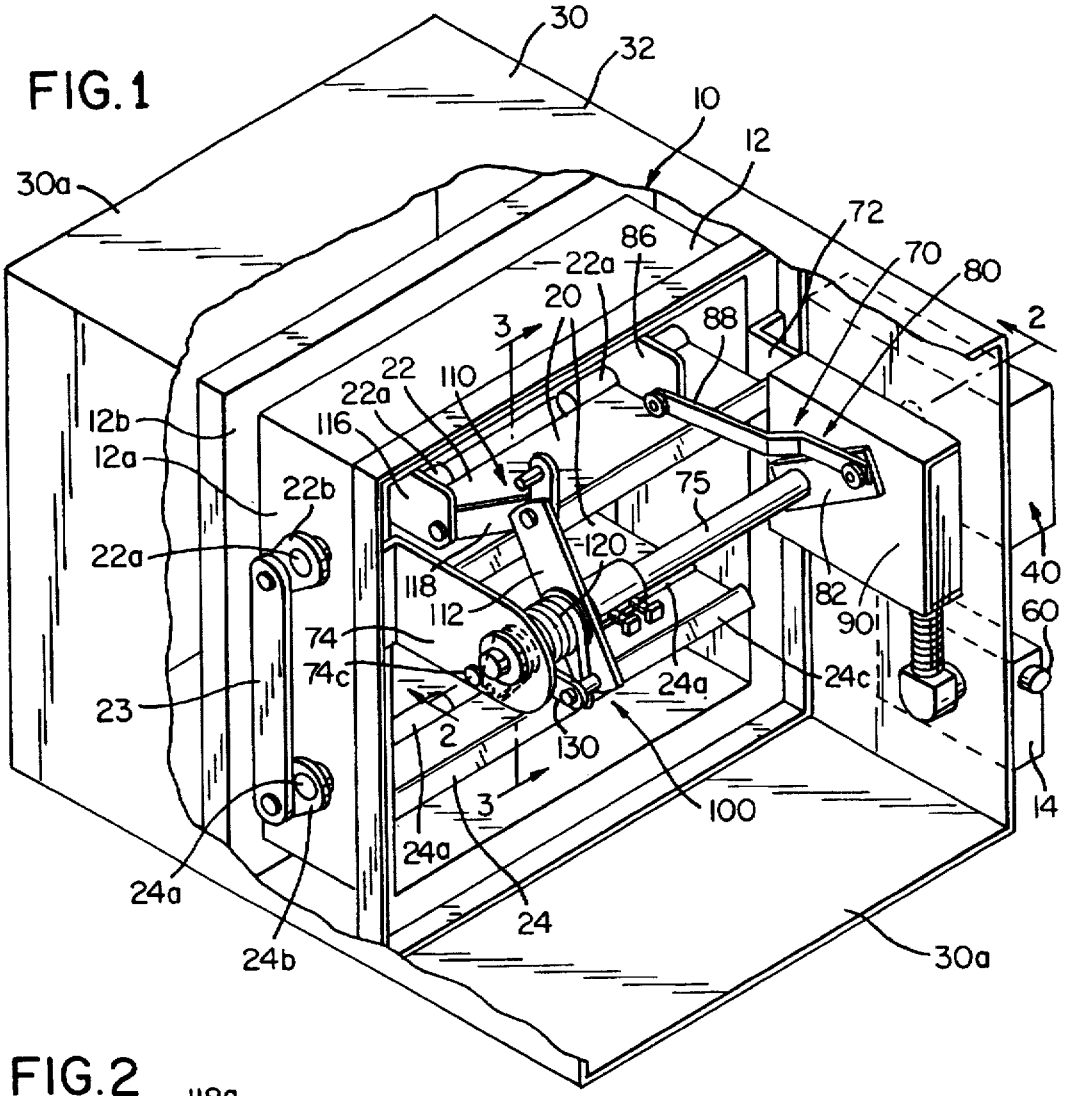
FIG. 1 a perspective view of a damper constructed in accordance with the present invention located in a sleeve where a portion of the sleeve is removed.

A damper 10 constructed in accordance with the present invention is illustrated in FIG. 1. It includes a peripheral frame 12 and barrier structure 20 coupled to the frame 12 which is movable between open and closed positions. In the illustrated embodiment, the damper 10 is located within a sleeve 30 which forms part of a heating or ventilating conduit 32 in a building. The conduit 32 further includes duct portions 34, see FIG. 10, which mate with end sections 30*a* of the sleeve 30. The barrier structure 20 permits fluid to flow through the conduit 32 when positioned in an open position, as shown in FIG. 1, and substantially blocks fluid flow through the conduit 32 when positioned in a closed position, see FIGS. 3 and 4. The damper 10 additionally includes an actuator 40 which is coupled to the barrier structure 20 for effecting movement of the barrier structure 20. A control circuit 50 is also provided and is connected to the actuator 40 for controlling operation of the actuator 40. The control circuit 50 includes a thermal responsive switch 60 which, preferably, is located outside of the conduit 32. In the embodiment illustrated in FIG. 1, the switch 60 is coupled to a junction box 14 which, in turn, is coupled to an outer surface of the sleeve 30. The thermal responsive switch 60 prevents operation of the actuator 40 when the temperature of fluid surrounding the switch 60 equals or exceeds a first predetermined value such that a spring (not shown) incorporated into the actuator 40 effects closure of the barrier structure 20.

The barrier structure 20 includes first and second movable barrier blades 22 and 24, see FIG. 1. The first barrier blade 22 is pivotably mounted to the frame 12 via two first barrier blade shafts 22*a*. The second barrier blade 24 is pivotably mounted to the frame 12 via two second barrier blade shafts 24*a*.

A first blade link 22b is fixedly mounted to one of the first barrier blade shafts 22a so as to rotate therewith, see FIG. 1. A second blade link 24b is fixedly mounted to one of the second barrier blade shafts 24a so as to rotate therewith. An intermediate link 23 is pivotably coupled to the first and second blade links 22b and 24b such that movement of the first blade 22 and its two associated blade shafts 22a effects movement of the second blade 24 and its two associated blade shafts 24a via the first, second and intermediate blade links 22b, 24b and 23.

As can be seen from FIG. 1, the first and second blade shafts 22a and 24a to which the first and second blade links 22b and 24b are coupled, extend through the frame 12. Further, the first, second and intermediate blade links 22b, 24b and 23 are positioned adjacent to an outer surface 12a of the frame 12. It is also contemplated that the first and second blade links 22b and 24b may be provided with extending stop portions (not shown) which are adapted to engage an outer side surface 12b of the frame 12 so as to prevent over-travel of the rotatable links 22b and 24b.

Further provided are upper and lower barrier portions 26 (only the upper portion is illustrated) which are fixedly mounted to the frame 12. When the barrier blades 22 and 24 are closed, a lower portion 22b of the first blade 22 engages an upper portion 24b of the second blade 24, an upper portion 22c of the first blade 22 engages the upper barrier portion 26 and a lower portion 24c of the second blade 24 engages the lower barrier portion. Fluid flow through the conduit 32 is substantially blocked by the blades 22 and 24 when they are in their closed position. When the blades 22 and 24 are open, fluid is permitted to flow through at least the portion of the conduit 32 in which the damper 10 is employed.

Figure 2:
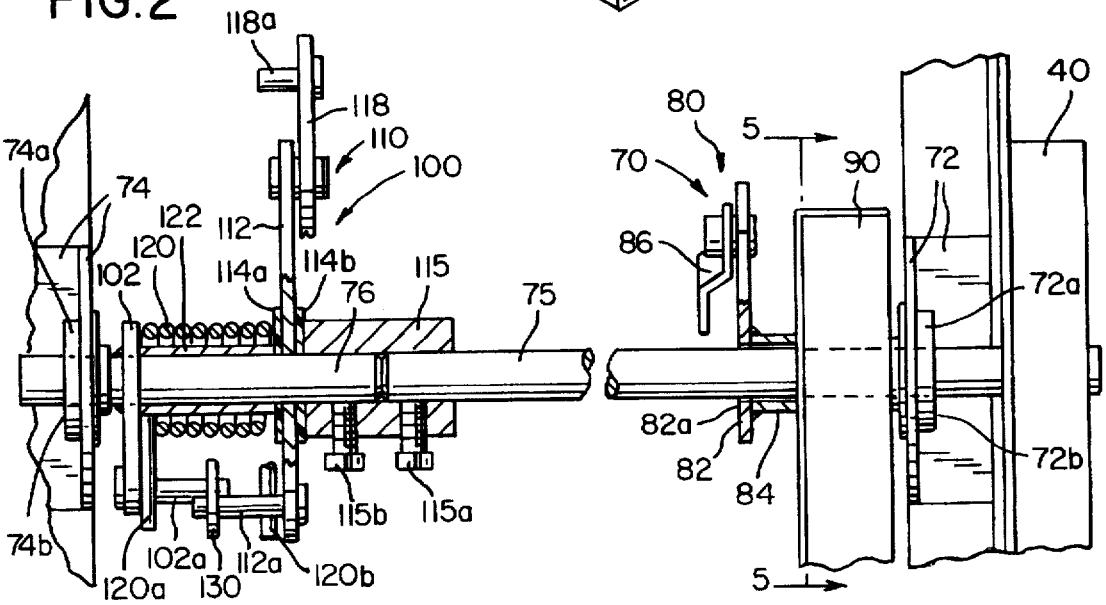
FIG. 2 is a view taken along view line 2—2 in FIG. 1.

The blades 22 and 24 are coupled to the actuator 40 via coupling structure 70. The coupling structure 70 comprises first and second support arms 72 and 74 which are fixedly connected to the frame 12, see FIGS. 1 and 2. The support arms 72 and 74 include first and second bearings 72a and 74a which are adapted to receive first and second drive shafts 75 and 76. The drive shafts 75 and 76 are coupled to one another via a collar 115 so as to rotate together. The collar 115 has one or more first bolts 115a which lockingly engage the first shaft 75 and one or more second bolts 115b which lockingly engage the second shaft 76.

The drive shaft 75 extends through the sleeve 30 and is coupled to the actuator 40. When power is provided to the actuator 40 by the circuit 50, the shaft 75 is rotated so as to maintain the blades 22 and 24 in an open condition. When power is removed from the actuator 40, the spring (not shown) incorporated into the actuator 40 effects closure of the blades 22 and 24.

A first spring clip (not shown) is mounted on the shaft 75 adjacent to a first side 72b of the bearing 72a. A second spring clip (not shown) is mounted on the shaft 76 adjacent to a first side 74b of the bearing 74a. The first and second clips prevent substantial axial movement of the shafts 75 and 76 in the bearings 72a and 74a.

The coupling structure 70 further includes a first linkage structure 80 which is coupled to the shaft 75 and to the blade 22 such that rotation of the shaft 75 via the actuator 40 effects movement of the blades 22 and 24. The first linkage structure 80 comprises a first arm 82 weldably coupled to a collar 84 which, in turn, is keyed to the shaft 75 so as to rotate with the shaft 75. The collar 84 extends through a microswitch housing 90 and terminates just before the bearing 72a. A third spring clip (not shown) is mounted on the shaft 75 adjacent to a first side 82a of the first arm 82 so as to prevent substantial axial movement of the first arm 82 along the shaft 75. A second arm 86 is fixedly coupled to the first blade 22. An intermediate arm 88 extends between the first and second arms 82 and 86 and is pivotably mounted to the first and second arms 82 and 86. Hence, rotation of the shaft 75 effects movement of the first blade 22 via the first, second and intermediate arms 82, 86 and 88. Movement of the first blade 22, in turn, effects movement of the second blade 24 via the first, second and intermediate blade links 22b, 24b and 23.

In the FIG. 1 embodiment, the damper 10 further includes a mechanical closure mechanism 100 for effecting closure of the barrier structure 20 when the temperature of fluid within the conduit 32 equals or exceeds a second predetermined value. The second value preferably is from about 160° F. to about 450° F. and, most preferably, is about 350° F. The first value is preferably from about 160° F. to about 286° F. and, most preferably, is about 165° F. The first value may equal the second value or the first value may be greater than the second value.

Figure 3:
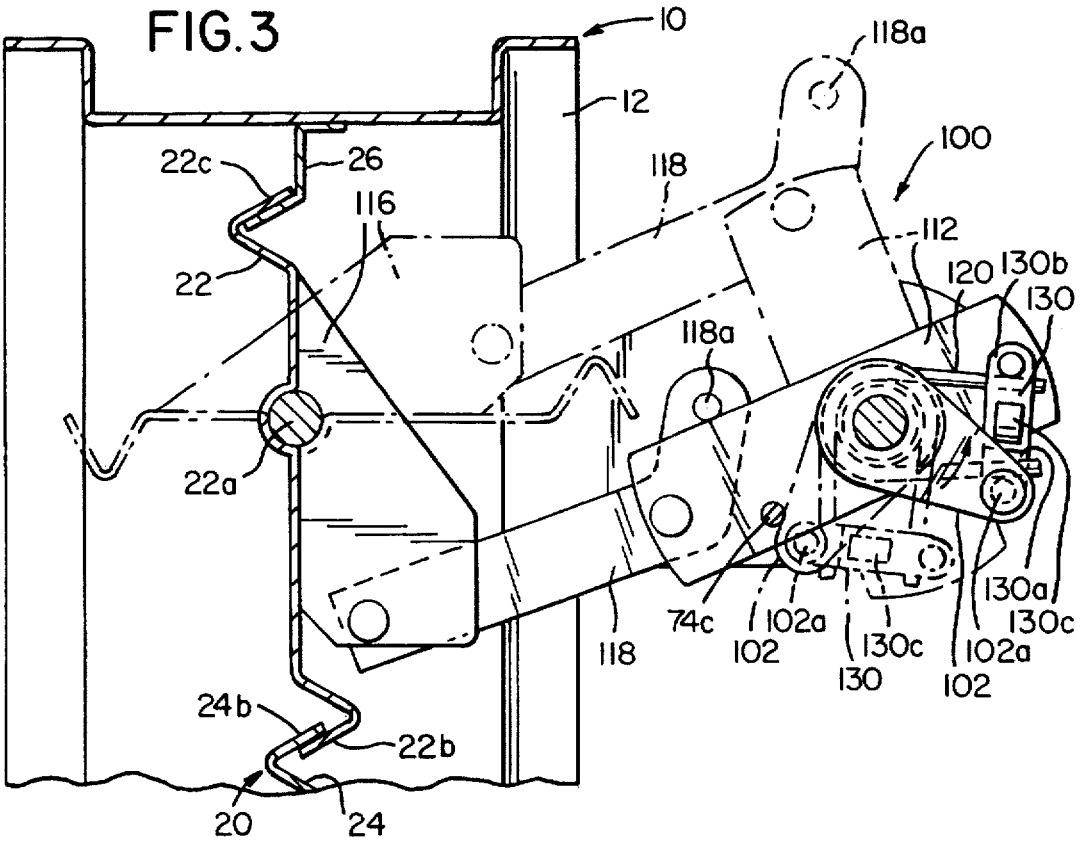
FIG. 3 is a view taken along view line 3—3 in FIG. 1.
Figure 4:
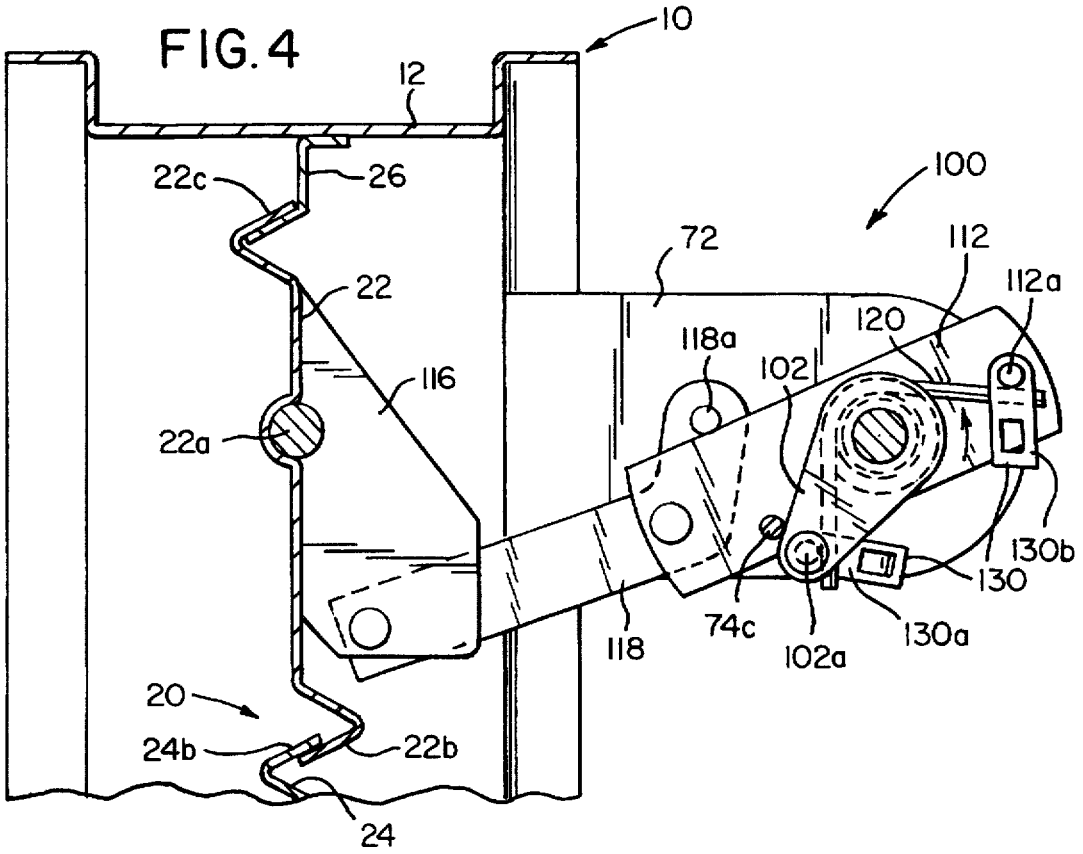
FIG. 4 is a view similar to FIG. 3 showing the blades in their closed position after failure of a fusible link forming part of a damper mechanical closure mechanism.

The mechanical closure mechanism 100 includes a first mechanical closure link 102 which is weldably coupled to the second drive shaft 76 so as to rotate with the drive shaft 76. The closure link 102 includes a first pin 102a. Once the actuator 40 has effected sufficient rotation of the shafts 75 and 76 so as to open the blades 22 and 24, the link 102 engages a stop pin 74c extending from the second support arm 74 to prevent further rotation of the shafts 75 and 76 and, hence, overtravel of the blades 22 and 24. In FIG. 3, the link 102, shown in phantom, is in engagement with the stop pin 74c.

The closure mechanism 100 further includes a second linkage structure 110 which is coupled to the drive shaft 76 and to the barrier blade 22. The second linkage structure 110 comprises a first arm 112 which is rotatably mounted on the shaft 76. It is positioned between opposing polymeric washers 114a and 114b. The collar 115 is located adjacent to the washer 114b. The first arm 112 includes a second pin 112a. The linkage structure 110 further includes a second arm 116 which is fixedly mounted to the blade 22 and an intermediate arm 118 extending between and pivotably connected to the first and second arms 112 and 116.

The closure mechanism 100 also includes a torsion spring 120 which is positioned about a collar 122 which, in turn, is positioned about the shaft 76. End sections 120a and 120b of the torsion spring 120 engage the first and second pins 102a and 112a.

A conventional fusible link 130 is connected to the first and second pins 102 and 112a. The fusible link 130 comprises first and second end sections 130a and 130b and an intermediate section 130c. The latter section 130c fails when it is heated to a temperature equal to the second value, thereby allowing the first and second sections 130a and 130b to separate from one another.

When the temperature of the fluid within the conduit 32 is less than the second value, the fusible link 130 prevents the torsion spring 120 from effecting movement of the second linkage structure 110 relative to the shaft 76. Further, the link 130 serves to couple the first arm 112 to the link 102 such that the first arm 112 moves with the link 102. Since the link 102 is fixed to the shaft 76, the first arm 112 also moves with the shaft 76. Thus, when the temperature of the fluid in the conduit 32 is less than the second value, the first, second and intermediate arms 112, 116 and 118 assist in closing the blades 22 and 24 when power is removed from the actuator 40 and the shafts 75 and 76 are rotated by the return spring incorporated into the actuator 40, see FIG. 3.

When the temperature in the conduit 32 equals or exceeds the second value, the intermediate section 130*c* of the fusible link 130 fails so as to decouple the first link section 130*a* from the second link section 130*b*. Thus, the torsion spring 120 is permitted to effect rotational movement of the first arm 112 about the shaft 76 via the spring's engagement with the second pin 112*a*, see FIG. 4. Movement of the link 102 is prevented by its engagement with the stop pin 74*c*. Movement of the first arm 112 which, in turn, effects movement of the second and intermediate arms 116 and 118, results in the closure of the barrier blades 22 and 24. The intermediate arm 118 includes a stop pin 118*a* which prevents further pivotal movement of the intermediate arm 118 relative to the first arm 112 once the blades 22 and 24 have closed.

Figure 8:
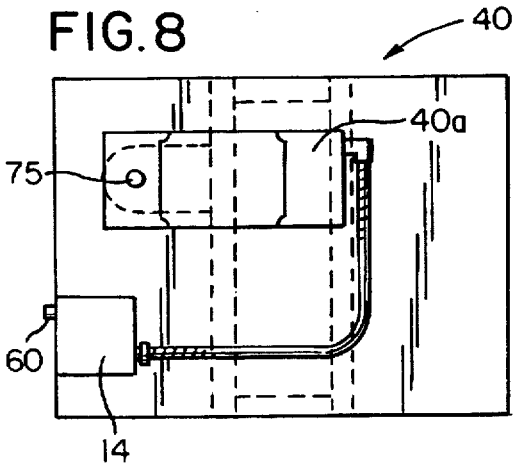
FIG. 8 is a view of an electric motor forming part of a damper constructed in accordance with one embodiment of the present invention.

The actuator 40 may comprise a commercially available electric motor 40*a*, see FIG. 8, having the return spring, mentioned above, incorporated therein. The motor 40*a* is coupled to the shaft 75 to apply torque to the shaft 75 so as to overcome the force applied by the return spring to maintain the blades 22 and 24 in their open condition. When power is removed from the motor 40*a*, the return spring effects rotation of the shafts 75 and 76 so as to close the blades 22 and 24.

Figure 6:
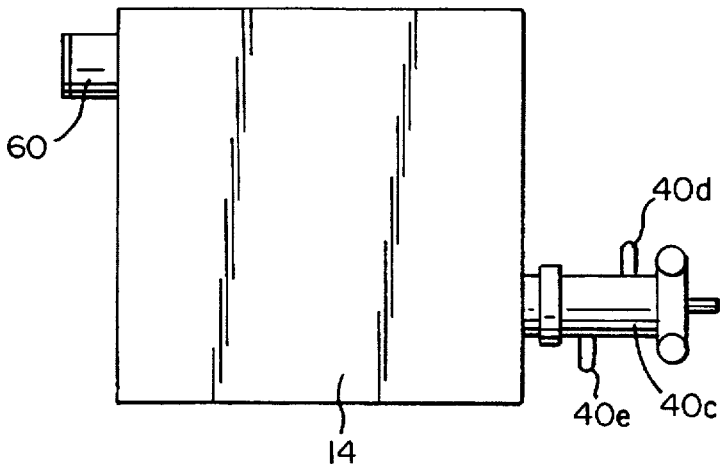
FIG. 6 is a view of a junction box including a thermal responsive switch and a pneumatic valve for controlling the flow of pressurized fluid to a pneumatic driver.
Figure 9:
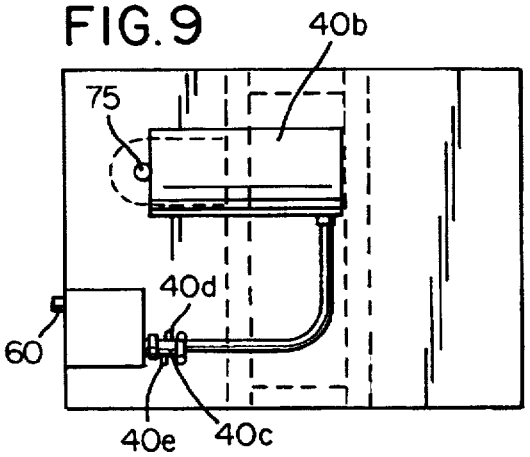
FIG. 9 is a view of a pneumatic actuator forming part of a damper constructed in accordance with another embodiment of the present invention.

Alternatively, the actuator may comprise a conventional pneumatic drive 40*b*, see FIG. 9, having the return spring, mentioned above, incorporated therein. The actuator further includes an electric/pneumatic valve 40*c*, see also FIG. 6. The valve 40*c* is coupled to the junction box 14 and provides pressurized air to and vents air from the drive 40*b* to effect rotation of the shafts 75 and 76. The valve 40*c* has a vent outlet 40*d* and a pressure inlet 40*e* which connects to a low pressure pneumatic supply line (not shown). When power is provided to the valve 40*c*, it supplies pressurized air to the drive 40*b* to apply torque to the shaft 75 so as to overcome the force of the return spring to open the blades 22 and 24. When power is removed from the valve 40*c*, air is vented from the drive 40*b* such that the return spring effects rotation of the shafts 75 and 76 to close the blades 22 and 24.

Figure 7:
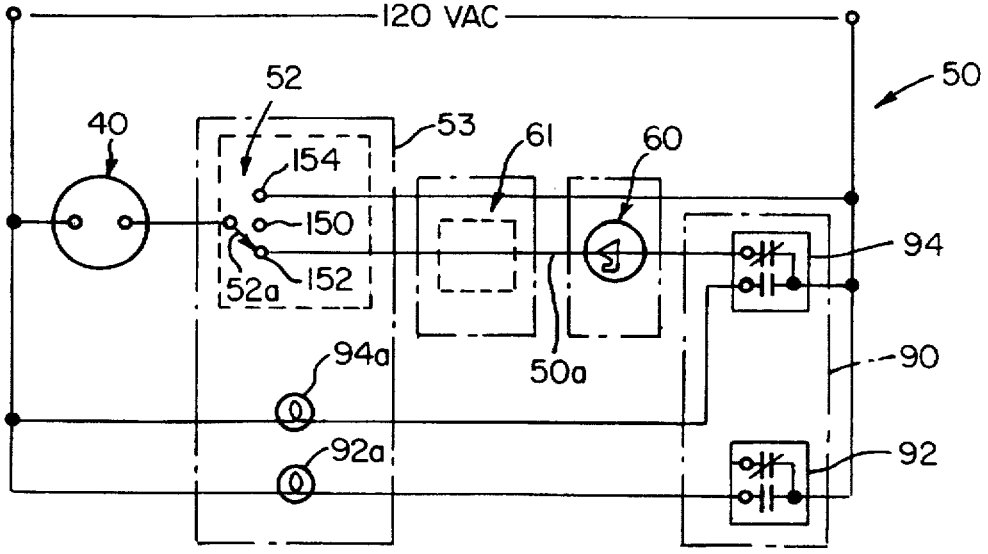
FIG. 7 is a schematic view of the control circuitry for the damper.

Referring now to FIG. 7, the control circuit 50, which is connected to a 120 VAC supply, includes a three position manually operable switch 52. Preferably, the switch 52 is located in a control panel 53 at a security station in the building in which the damper 10 is employed. When a pole piece 52*a* of the switch 52 is connected to a contact 150, power is removed from the actuator 40 such that the blades 22 and 24 are moved to their closed position via the return spring in the actuator 40. It is also contemplated that a power supply other than a 120 VAC supply may be provided.

When the pole piece 52*a* is moved to connect with a contact 152, it is in its "normal" operating position. Typically, when the pole piece 52*a* is in this position, power is provided to the actuator 40 so as to maintain the blades 22 and 24 in their open condition. However, if the temperature of the air outside of the conduit 32 equals or exceeds the first predetermined value, the switch 60 is actuated to open line 50*a* such that power is decoupled from the actuator 40. Line 50*a* may also be opened via actuation of a conventional smoke detector 61 which is located inside the conduit 32, outside of the conduit 32 or in a room adjacent to where the conduit 32 is located. When power to the actuator 40 is interrupted and the blades 22 and 24 are closed, the conduit 32 is closed off to the transmission of fire or smoke through it.

The blades 22 and 24 are also moved to their closed state if the temperature of the fluid inside of the conduit 32 equals or exceeds the second value. When this occurs, the intermediate section 130*c* of the fusible link 130 fails such that the torsion spring 120 effects movement of the first and second blades 22 and 24 to their closed position.

When the pole piece 52*a* is moved to connect with a contact 154, it is in its "open" or "override"0 position. If the blades 22 and 24 are closed as a result of actuation of either the switch 60 or the smoke detector 61, contact of the pole piece 52*a* with the contact 154 results in power being restored to the actuator 40 such that the blades 22 and 24 are moved to their open position. However, if the intermediate section 130*c* of the link 130 has failed, movement of the pole piece 52*a* to the contact 154 will not result in the reopening of the blades 22 and 24 as the arm 112 moves relative to the shaft 76 when the intermediate section 130*c* has failed.

Operation of the switch 52 to reopen the blades 22 and 24 of the damper 10 in a particular section of a building conduit may be desirable so as to vent toxic fumes or smoke from the building. Reopening of the damper 10 may also provide useful information to an operator charged with safety in a building. If the damper can be reopened, the operator knows that the damper was closed due to actuation of the thermal responsive switch 60 or the smoke detector 61. Hence, the heat or smoke source is most likely outside of the conduit 32, assuming both the switch 60 and the smoke detector 61 are located outside of the conduit 32. If the damper 10 cannot be reopened, the operator knows that the temperature within the conduit 32 is equal to or exceeds the second predetermined value as the intermediate section 130*c* of the link 130 has failed. Thus, heated fluid or fire is located within the conduit 32.

Figure 5:
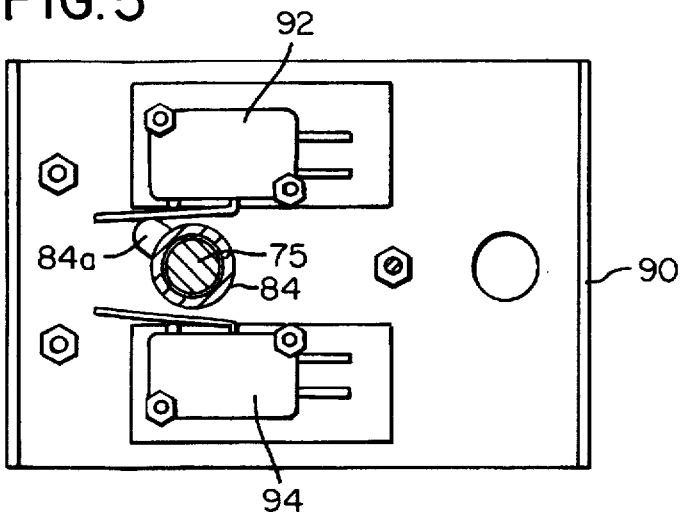
FIG. 5 is a view of a drive shaft collar provided with a switch actuator element and first and second microswitches for actuating first and second blade position indicator lamps.
Figure 10:
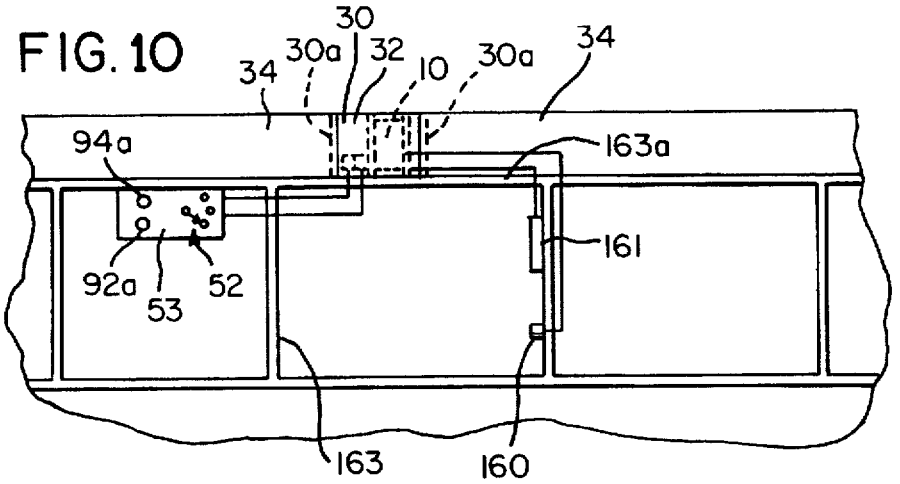
FIG. 10 is a view illustrating a further embodiment of the present invention where the thermal responsive switch is positioned so as to sense the temperature of fluid within a room located adjacent to the conduit in which the damper is located.

Further provided are two indicator lamps 92*a* and 94*a* which, in the illustrated embodiment, are located in the control panel 53, see FIGS. 7 and 10. Also provided are first and second microswitches 92 and 94 which are housed within the microswitch housing 90, see FIGS. 5 and 7. An actuator element 84*a* is fixedly coupled to the collar 84 which, as noted above, is coupled to the shaft 75 so as to rotate therewith. Thus, the element 84*a* actuates the switch 92 when the blades 22 and 24 are in their open condition so as to provide power to the lamp 92*a*. The lamp 92*a*, when powered, provides an indication that the blades 22 and 24 are in their open condition. When the shaft 75 is moved so as to close the blades 22 and 24, the actuator element 84*a* actuates switch 94 so as to provide power to the lamp 94*a*. The lamp 94*a*, when powered, provides an indication that the blades 22 and 24 are in their closed condition.

In accordance with a second embodiment of the present invention, the thermal responsive switch 160 and the smoke detector 161 are located within or extend into a room 163 which is spaced from the conduit 32 in which the damper frame 12 is located, see FIG. 10. In the illustrated embodiment, a wall 163*a* is interposed between the conduit 32 and the room 163. In this embodiment, the damper blades 22 and 24 are closed if the temperature of the fluid within the room 163 equals or exceeds the first value or a sufficient amount of smoke is detected in the room 163 such that the smoke detector 161 is actuated.

Figure 11:
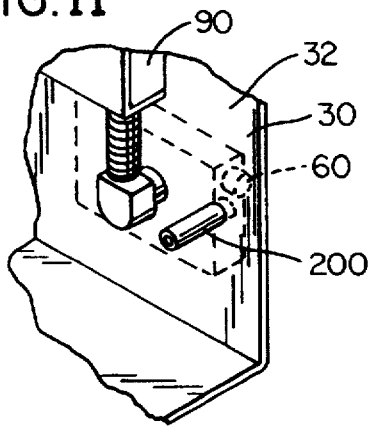
FIG. 11 is a view of another embodiment of the present invention where the sleeve in which the damper is employed includes a tube which extends through the sleeve so as to provide a path for heated air to move from inside the sleeve to outside the sleeve.

In accordance with a third embodiment of the present invention, a tube 200 extends through the sleeve 30 so as to provide a pathway for heated air to move from inside the conduit 32 to outside of the conduit 32, see FIG. 11. If a sufficient amount of heated air passes through the conduit 32 such that the air surrounding the sensor 60 is at a temperature equal to or greater than the first value, the switch 60 will be actuated such that the blades 22 and 24 are closed.

It is further contemplated that the mechanical mechanism 100 may be replaced by a second thermal responsive switch (not shown) located within the sleeve 30. The second switch may be actuated at a temperature equal to the second value or at a different temperature. It is additionally contemplated that the mechanical mechanism 100 may be used in combination with the sensor 60 and a second thermal responsive sensor (not shown) located within the conduit 32. The second sensor may be actuated at a temperature equal to the first or second values or at a third value which differs from the first and second values.

In addition to being coupled to the junction box 14, the thermal responsive switch 60 may be fixedly connected to any portion of the conduit 32, the damper frame 12 or the building in which the damper 10 is located.

The thermal responsive switch 60 is commercially available from Thermodisc Inc.

It is also contemplated that the barrier structure may comprise one or more than two barrier blades.

Having described the invention in detail and by reference to a preferred embodiment thereof, it will be apparent that modifications and variations are possible without departing from the scope of the invention defined in the appended claims.

What is claimed is:

1. A damper adapted to be positioned in a building conduit to control the flow of fluid through the conduit, said damper comprising:

a frame adapted to be positioned within the conduit;

barrier structure coupled to said frame and movable between open and closed positions, said barrier structure permitting fluid to flow through the conduit when positioned in said open position and substantially blocking fluid flow through the conduit when positioned in said closed position;

an actuator coupled to said barrier structure for effecting movement of said barrier structure; and a control circuit connected to said actuator for controlling operation of said actuator, said control circuit including a thermal responsive switch located outside of the conduit, said switch preventing operation of said actuator when the temperature of fluid at a location outside of the conduit exceeds a first predetermined value.

2. A damper as set forth in claim 1, wherein said control circuit further includes an override switch which bypasses said thermal switch such that said actuator can be operated when said thermal responsive switch is actuated in response to the fluid temperature exceeding said first value.

3. A damper as set forth in claim 1, wherein said control circuit further includes first and second indicator lamps, said first indicator lamp being activated when said barrier structure is positioned in its open position and said second indicator lamp being activated when said barrier structure is positioned in its closed position.

4. A damper as set forth in claim 1, wherein said barrier structure comprises a plurality of barrier blades pivotably mounted to said frame and coupled to said actuator via coupling structure, said blades being movable between an open position such that they permit fluid flow through the conduit and a closed position where they substantially block fluid flow through the conduit.

5. A damper as set forth in claim 4, wherein said coupling structure comprises a drive shaft coupled to said actuator and linkage structure fixedly coupled to said shaft and to said barrier blades such that rotation of said shaft via said actuator effects movement of said blades between said open and closed positions.

6. A damper as set forth in claim 1, wherein said thermal responsive switch is coupled to the conduit.

7. A damper as set forth in claim 1, wherein said thermal responsive switch is located in a room spaced from the conduit.

8. A damper as set forth in claim 1, wherein the conduit includes a sleeve and at least one duct portion which is coupled to the sleeve, said frame is positioned in the sleeve and said thermal responsive switch is coupled to the sleeve.

9. A damper as set forth in claim 1, further including a mechanical closure mechanism for effecting closure of said barrier structure when the temperature of fluid within the conduit exceeds a second predetermined value.

10. A damper as set forth in claim 9, wherein said second value is greater than said first value.

11. A damper adapted to be positioned in a building conduit to control the flow of fluid through the conduit, said damper comprising:

a frame adapted to be positioned within the conduit;

barrier structure coupled to said frame and movable between open and closed positions, said barrier structure permitting fluid to flow through the conduit when positioned in said open position and substantially blocking fluid flow through the conduit when positioned in said closed position;

an actuator coupled to said barrier structure for effecting movement of said barrier structure; and a control circuit connected to said actuator and a power source for coupling said power source to said actuator, said control circuit including a first thermal responsive switch positioned so as to sense the temperature of fluid at a location outside of the conduit, said switch decoupling said power source from said actuator when the temperature of the fluid surrounding said switch exceeds a first predetermined value.

12. A damper as set forth in claim 11, wherein said control circuit further includes an override switch which bypasses said thermal switch such that said power source is not decoupled from said actuator when said thermal switch is actuated in response to the fluid temperature exceeding said first value.

13. A damper as set forth in claim 11, wherein said barrier structure comprises a plurality of barrier blades pivotably mounted to said frame and coupled to said actuator via coupling structure, said blades being movable between an open position such that they permit fluid flow through the conduit and a closed position where they substantially block fluid flow through the conduit.

14. A damper as set forth in claim 13, wherein said coupling structure comprises a drive shaft coupled to said actuator and first linkage structure fixedly coupled to said shaft and to said barrier blades such that rotation of said shaft via said actuator effects movement of said blades between said open and closed positions.

15. A damper as set forth in claim 14, further including a mechanical closure mechanism for effecting closure of said barrier structure when the temperature of fluid within the conduit exceeds a second predetermined value.

16. A damper as set forth in claim 15, wherein said second value is greater than said first value.

17. A damper as set forth in claim 15, wherein said mechanical closure mechanism includes:

a first mechanical closure link fixedly coupled to said drive shaft and including a first pin;

a second linkage structure rotatably coupled to said drive shaft and fixedly coupled to said barrier blades such that movement of said second linkage structure effects movement of said blades, said second linkage structure including a second pin;

a torsion spring positioned about said drive shaft and engaging said first and second pins; and a fusible link connected to said first and second pins for preventing said torsion spring from effecting movement of said second linkage structure when the temperature of the fluid within the conduit is less than said second value and failing when the temperature of the conduit fluid exceeds said second value thereby allowing said torsion spring to effect movement of said second linkage structure such that said barrier blades are substantially closed.

18. A damper as set forth in claim 11, wherein said thermal responsive switch is coupled to the conduit.

19. A damper as set forth in claim 11, wherein said thermal responsive switch is located in a room spaced from the conduit.

20. A damper as set forth in claim 11, wherein the conduit includes a sleeve and at least one duct portion which is coupled to the sleeve, said frame is positioned in the sleeve and said thermal responsive switch is coupled to the sleeve.

21. A damper as set forth in claim 20, wherein the conduit includes a tube which extends through the sleeve so as to provide a path for heated air to move from inside the sleeve to outside the sleeve adjacent to said thermal responsive switch.

22. A damper as set forth in claim 20, wherein said control circuit further includes a second thermal responsive switch positioned to sense the temperature of fluid at a location inside the conduit, said second switch decoupling said power source from said actuator when the temperature of the fluid surrounding said second switch exceeds a third predetermined value.

23. A damper as set forth in claim 22, wherein said third predetermined value is substantially equal to said first predetermined value.

24. A damper as set forth in claim 22, wherein said third predetermined value is greater than said first predetermined value.

25. A damper as set forth in claim 22, wherein said third predetermined value is less than said first predetermined value.

* * * * *